US006997623B2

(12) United States Patent
Nebashi

(10) Patent No.: US 6,997,623 B2
(45) Date of Patent: Feb. 14, 2006

(54) PRINTER

(75) Inventor: Mitsuhiko Nebashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/912,549

(22) Filed: Aug. 6, 2004

(65) Prior Publication Data

US 2005/0063748 A1 Mar. 24, 2005

Related U.S. Application Data

(63) Continuation of application No. 10/347,508, filed on Jan. 21, 2003, now Pat. No. 6,793,419.

(30) Foreign Application Priority Data

Jan. 18, 2002 (JP) ..... P2002-010699

(51) Int. Cl.
*B41J 11/20* (2006.01)
*B41J 11/70* (2006.01)

(52) U.S. Cl. ..... 400/55; 400/56; 400/58; 400/613; 400/621

(58) Field of Classification Search ..... 101/55–56, 101/58, 613, 621; 400/55–58, 613, 621
See application file for complete search history.

(56) References Cited

U.S. PATENT DOCUMENTS

| | | | | |
|---|---|---|---|---|
| 5,129,750 | A | 7/1992 | Otsuki | |
| 5,139,351 | A | 8/1992 | Kamada | |
| 5,631,690 | A | 5/1997 | Tashiro et al. | |
| 5,791,796 | A | 8/1998 | Gustavsson et al. | |
| 5,833,380 | A | 11/1998 | Hosomi et al. | |
| 5,993,093 | A | 11/1999 | Schoennauer et al. | |
| 6,257,779 | B1 | 7/2001 | Harris et al. | |
| 6,361,231 | B1 | 3/2002 | Sato et al. | |
| 6,758,614 | B1 * | 7/2004 | Yamada et al. | 400/58 |

FOREIGN PATENT DOCUMENTS

| | | |
|---|---|---|
| EP | 0 372 753 | 6/1990 |
| EP | 0 764 542 | 3/1997 |
| EP | 1 038 687 | 9/2000 |
| JP | 1-106251 | 7/1989 |
| JP | 2000-108430 | 4/2000 |
| JP | 2000-272200 | 10/2000 |
| JP | 2000-326530 | 11/2000 |

* cited by examiner

*Primary Examiner*—Andrew H. Hirshfeld
*Assistant Examiner*—Marissa Ferguson
(74) *Attorney, Agent, or Firm*—Nixon & Vanderhye P.C.

(57) ABSTRACT

A printer unit comprises a first positioning mechanism and a second positioning mechanism for positioning a platen with respect to a print head when a cover frame is closed. The first positioning mechanism is constituted to restrict a change in the position of the platen to a rotation around a first positioning fulcrum, such as a lock pin. The second positioning mechanism is constituted to restrict the rotation of the platen around a first positioning fulcrum by abutment on a second positioning fulcrum, such as a lock lever spindle.

5 Claims, 11 Drawing Sheets

PRINTER

CROSS-REFERENCES TO RELATED APPLICATIONS

This application is a continuation of U.S. patent application Ser. No. 10/347,508, filed Jan. 21, 2003 now U.S. Pat. No. 6,793,419. The entire contents of this application is incorporated herein by reference.

BACKGROUND OF THE INVENTION

1. Field of the Invention

The present invention relates to a printer for positioning a platen provided on a cover frame with respect to a print head provided on a body frame when the cover frame is closed.

2. Related Art

In the related art, there is known a printer for storing a continuous paper such as a rolled paper therein and carrying out printing while pulling out the continuous paper. In a printer of this type, to change the continuous paper, it is necessary to manually pull out the continuous paper and take the continuous paper along a predetermined paper path. For this reason, a platen to be disposed in an opposite position to the print head is provided on the cover side of the printer for opening and closing a continuous paper exchange port such that the paper path is opened with an operation for opening a cover.

In the case in which the print head is of a dot impact type or an ink jet type, moreover, a predetermined gap (a platen gap) is to be maintained between the print head and the platen and the platen is to be provided in parallel with the printing line of the print head in order to assure printing quality.

However, the related art printer is positioned by the engagement of a lock lever provided rotatably on the cover frame and a lock pin provided on the body frame. Therefore, there is a possibility that positioning precision in the platen might be deteriorated by the influence of the attachment looseness of the cover frame to the body frame.

SUMMARY OF THE INVENTION

It is an object of the invention to provide a printer in which a platen provided on a cover frame can be positioned with high precision with respect to a print head provided on a body frame when the cover frame is closed. This high precision can be achieved by print head eliminating the influence of the attachment looseness of the cover frame to the body frame so that a predetermined gap can be maintained between the print head and the platen, and the platen can be provided in parallel with the printing line of the print head so that printing quality can be enhanced.

In order to attain the above object, the invention provides a printer comprising a print head provided on a body frame, a cover frame provided on the body frame to freely carry out an opening and closing operation, a platen provided on the cover frame and opposed to the print head with a predetermined gap when the cover frame is closed, a first positioning mechanism for positioning the platen with respect to the print head when the cover frame is closed to restrict a change in a position of the platen to a rotation around a first positioning fulcrum, and a second positioning mechanism for positioning the platen with respect to the print head when the cover frame is closed to restrict the rotation of the platen around the first positioning fulcrum by abutment on a second positioning fulcrum.

Moreover, it is preferable that the first positioning fulcrum should be provided on a first virtual line which passes through a printing position of the print head and is substantially perpendicular to a surface of the platen which is opposed to the print head with the predetermined gap when the cover frame is closed.

In short, a plane defined by the printing line and the first positioning fulcrum is substantially orthogonal to a surface of the platen which is opposed to the print head with the predetermined gap when the cover frame is closed.

In this case, the amount of a change in the platen gap caused by the rotation of the platen is minimized. Consequently, precision in the platen gap can be enhanced to improve printing quality.

Furthermore, it is preferable that the first positioning mechanism should include a lock pin provided on the body frame and acting as the first positioning fulcrum, a lock lever provided rotatably on the platen or the cover frame through a lock lever spindle and engaged with the lock pin to lock an operation for opening and closing the cover frame when the cover frame is closed, the lock lever is spindle provided on the platen or the cover frame and acting as the second positioning fulcrum, and a first positioning groove provided on the platen or the cover frame and serving to restrict a change in a position of the platen to only a rotation around the lock pin along an outer periphery of the lock pin when the cover frame is closed. In this case, it is possible to constitute the first positioning mechanism by such a change as to add the first positioning groove to a related art lock lever mechanism. Therefore, the number of components can be reduced and the structure of the printer can be simplified.

Moreover, it is preferable that the second positioning mechanism should include a second positioning groove provided on the body frame and serving to restrict a rotation of the platen around the lock pin by abutment of the lock lever spindle on a groove inner edge portion when the cover frame is closed. In this case, the second positioning mechanism is constituted by utilizing a lock lever spindle. Consequently, the number of components can be reduced and the structure can be simplified. In addition, a distance between the first positioning fulcrum and the second positioning fulcrum is maintained to be constant by the lock lever. Consequently, positioning precision in the platen can further be enhanced.

Furthermore, it is preferable that the printer should further comprise a paper feed roller provided on one of the body frame and the cover frame, and a paper press roller provided on the other of the body frame and the cover frame and abutting on the paper feed roller when the cover frame is closed, the first positioning fulcrum being provided in a position offset from a second virtual line passing through centers of the paper feed roller and the paper press roller as seen from a side. In other words, the first positioning fulcrum is provided on an outside of a plane defined by an axis of the paper feed roller and that of the paper press roller.

In this case, a moment in a constant direction around the first positioning fulcrum is applied to the platen by a reaction force acting on the paper press roller. Therefore, the abutment position of the second positioning fulcrum and the second positioning groove can be specified to further enhance the positioning precision in the platen.

Moreover, it is preferable that the printer should comprise a spring for urging the paper press roller toward the paper feed roller side. In this case, a constant reaction force (spring force) acts on the paper press roller. Therefore, a moment in a constant direction can be reliably applied to the platen.

DETAILED DESCRIPTION OF THE INVENTION

Figure 1:
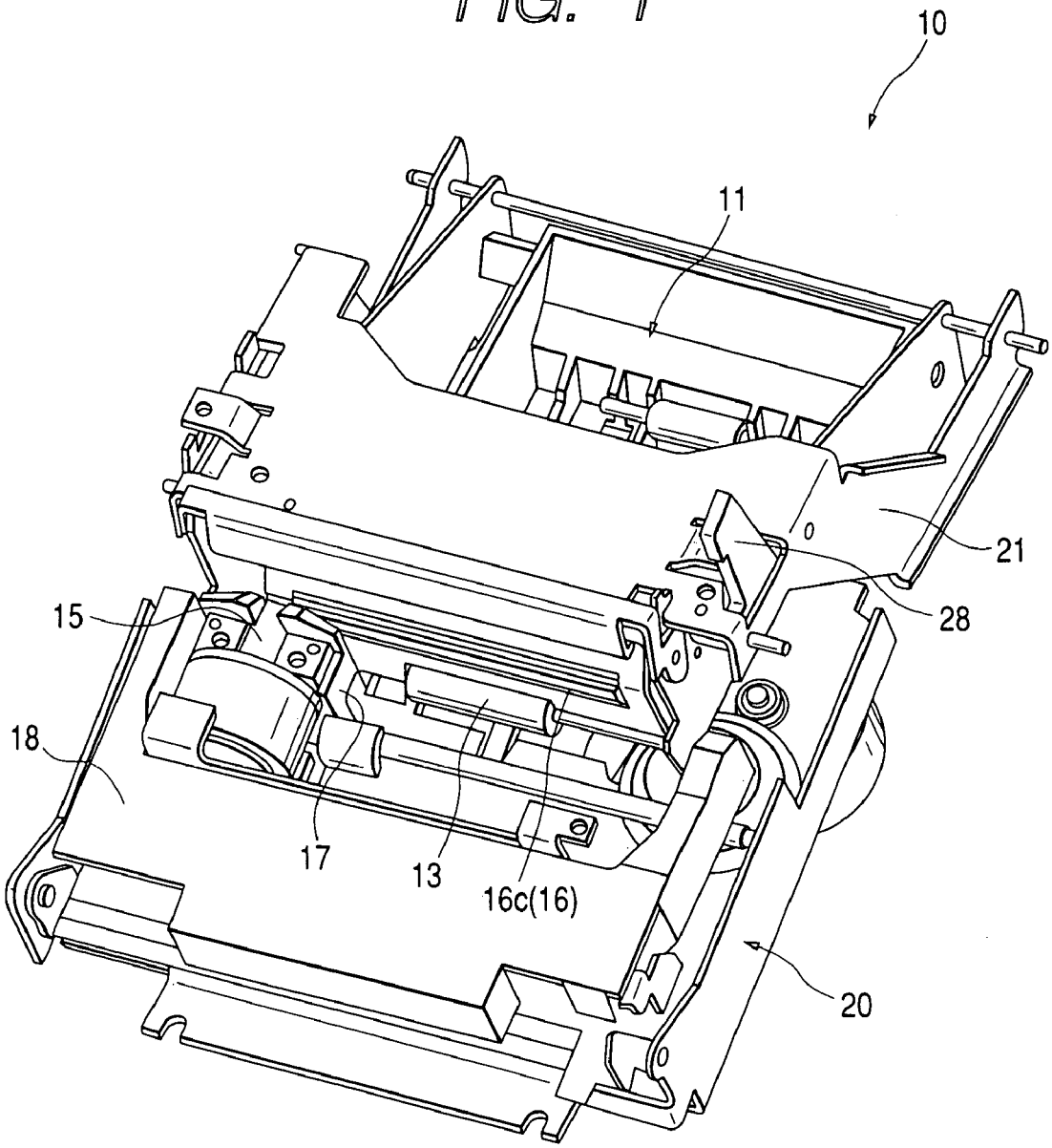
FIG. 1 is a perspective view showing a state in which the cover frame of a printer unit is closed according to an embodiment of the invention.
Figure 2:
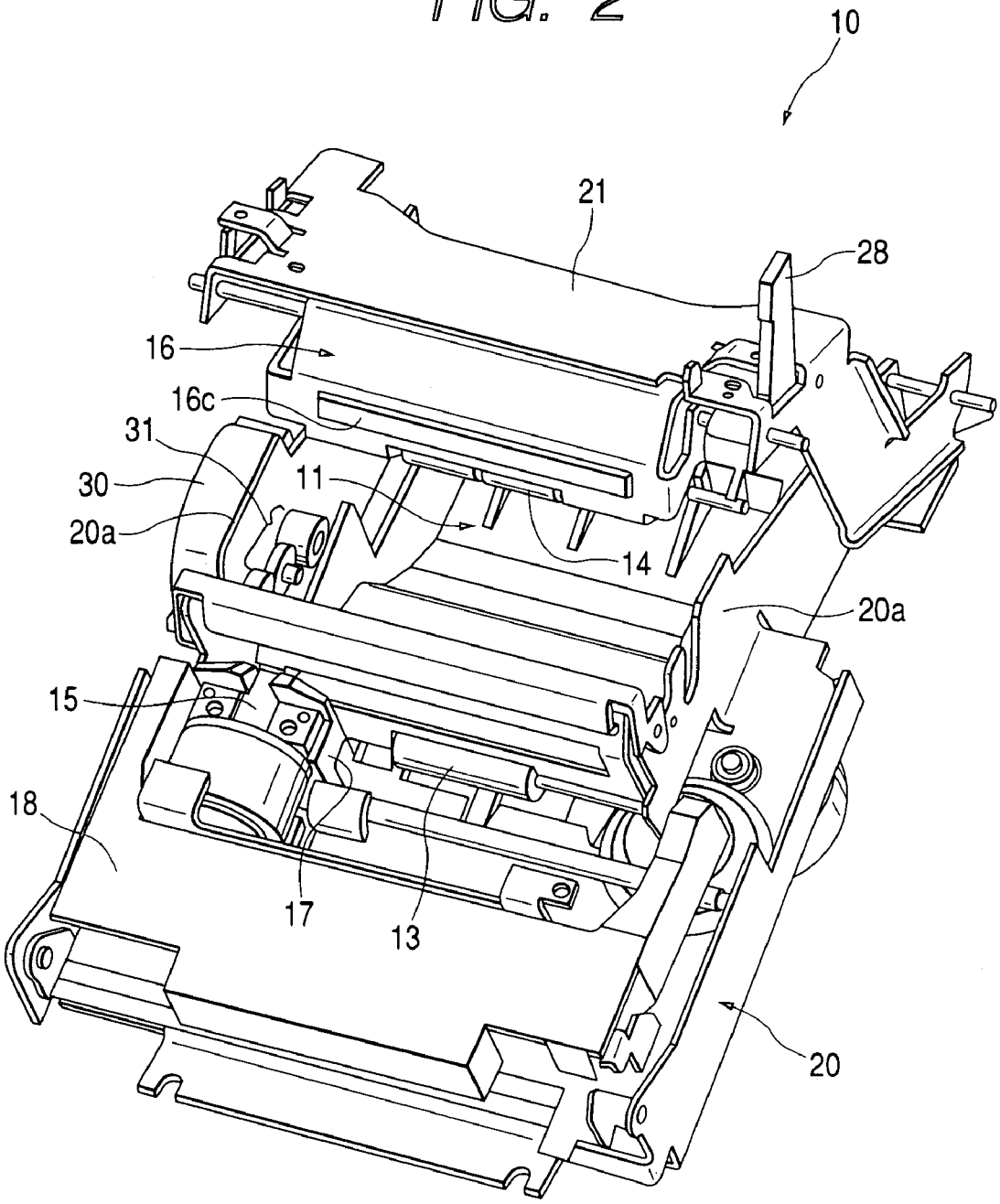
FIG. 2 is a perspective view showing a state in which the cover frame is opened (a half-open state) in the printer unit of FIG. 1.
Figure 3:
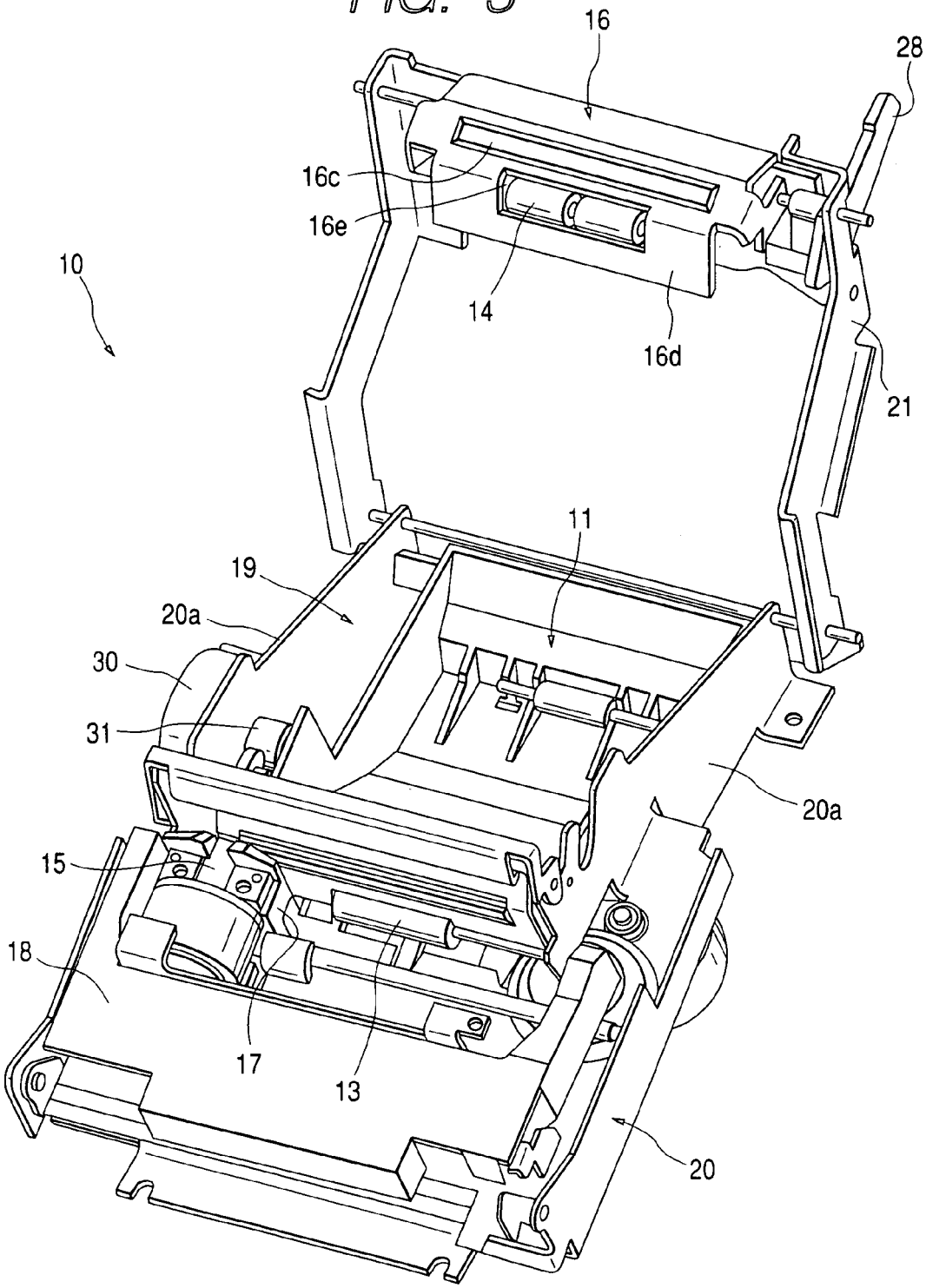
FIG. 3 is a perspective view showing a state in which the cover frame is opened (a full-open state) in the printer unit of FIG. 1.

An embodiment of the invention will be described below with reference to the drawings. FIG. 1 is a perspective view showing a printer unit, illustrating a state in which a cover frame is closed, FIG. 2 is a perspective view showing the printer unit, illustrating a state in which the cover frame is opened (a half-open state), and FIG. 3 is a perspective view showing the printer unit, illustrating a state in which the cover frame is opened (a full-open state). A printer unit 10 shown in these drawings is incorporated in a predetermined housing to constitute a printer. The printer unit 10 comprises a housing 11 for storing a roll-shaped continuous paper P therein, and one end side of the continuous paper P held rotatably in the housing 11 is pulled out of the upper part of the printer unit 10 through a paper path 12. The paper path 12 is provided with a paper feed roller 13 for delivering the continuous paper P, a paper press roller 14 for pushing the continuous paper P against the paper feed roller 13, a dot impact type print head 15 for carrying out printing on the continuous paper P, and a platen 16 for holding the back face of the continuous paper P in the opposite position of the print head 15.

The print head 15 is provided on a carriage 17 for reciprocating in a transverse direction (a direction of the width of the paper path 12). An ink ribbon is supplied from an ink ribbon cassette 18 to the moving area of the print head 15. The impact pin of the print head 15 is protruded in a state in which the ink ribbon is provided between the print head 15 and the continuous paper P. Thus, dot matrix printing is carried out on the continuous paper P.

An opening 19 is formed above the housing 11 in order to exchange the continuous paper P. A side frame 20*a* constituting a part of a body frame 20 is erected on the left and right sides of the housing 11, and the opening 19 is opened and closed by a cover frame 21 which is rotatably supported on the rear part of the side frame 20*a*. The cover frame 21 includes or houses the platen 16 and the paper press roller 14 in a tip portion thereof. When the cover frame 21 is opened, the platen 16 and the paper press roller 14 retreat so that the paper path 12 is opened. In other words, when the continuous paper P is to be exchanged, the cover frame 21 is opened to store the continuous paper P in the housing 11 and one end side of the continuous paper P is then pulled up to the outside of the housing. Thereafter, the cover frame 21 is closed so that the continuous paper P is set along the paper path 12. A motor 30 for driving the paper feed roller 13 is fixed to the outside of one of the side frames 20*a*. Moreover, a gear train 31 for transmitting the power of the motor 30 to the paper feed roller 13 is provided on the outside of the same side frame 20*a*.

Figure 4:
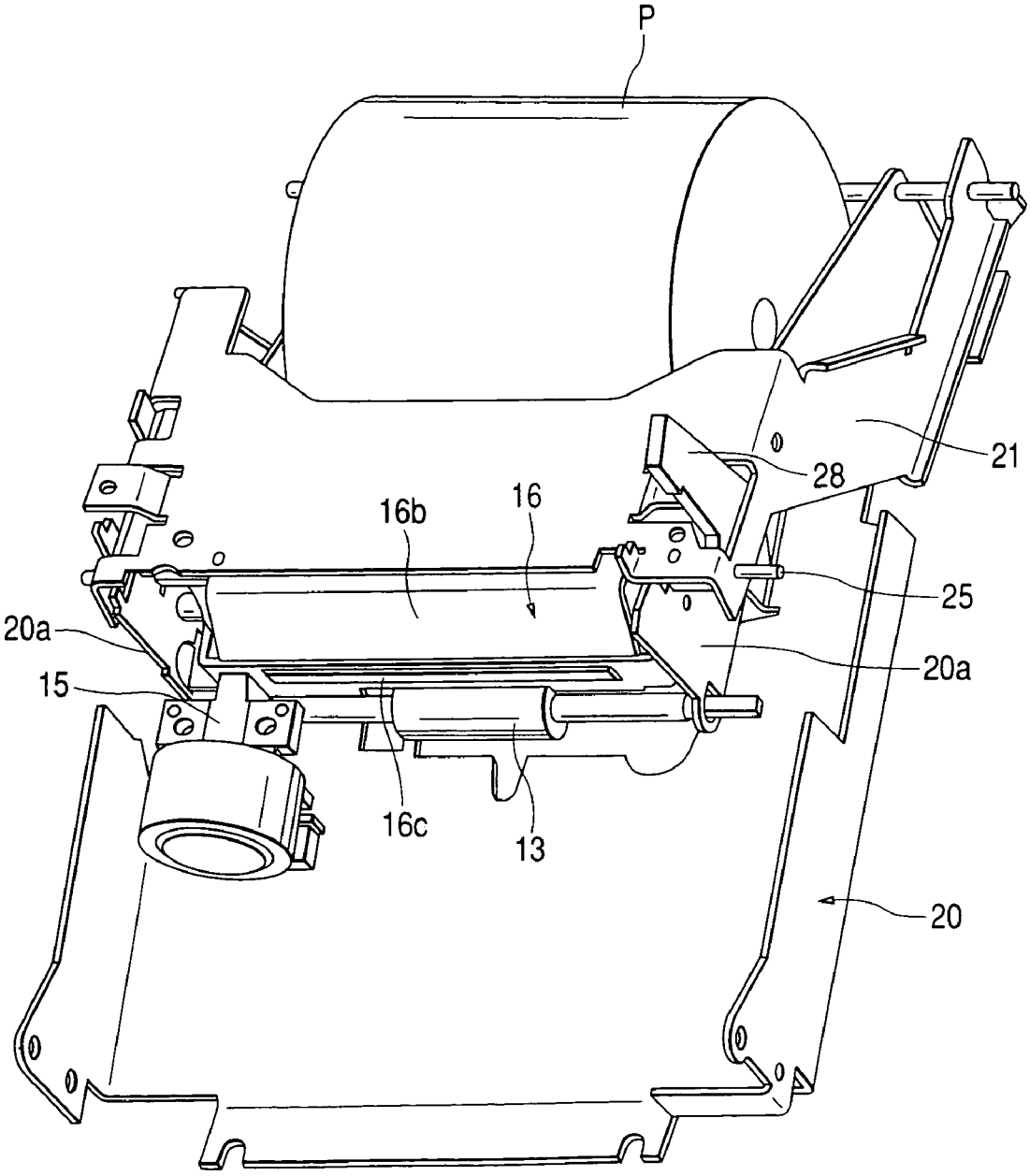
FIG. 4 is a perspective view showing a main part, illustrating a state in which the cover frame is closed in the printer unit of FIG. 1.
Figure 5:
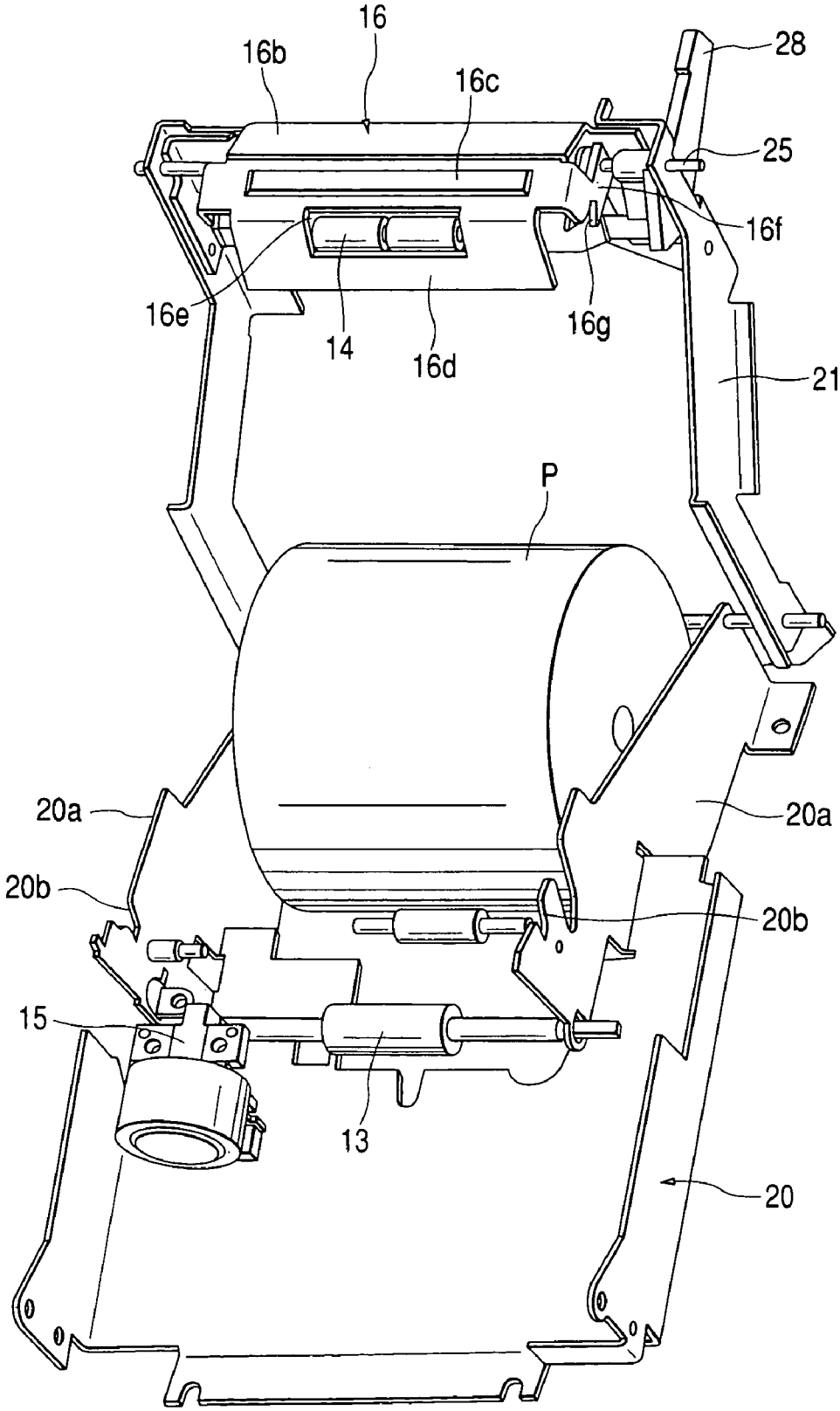
FIG. 5 is a perspective view showing the main part, illustrating a state in which the cover frame is opened in the printer unit of FIG. 1.
Figure 6:
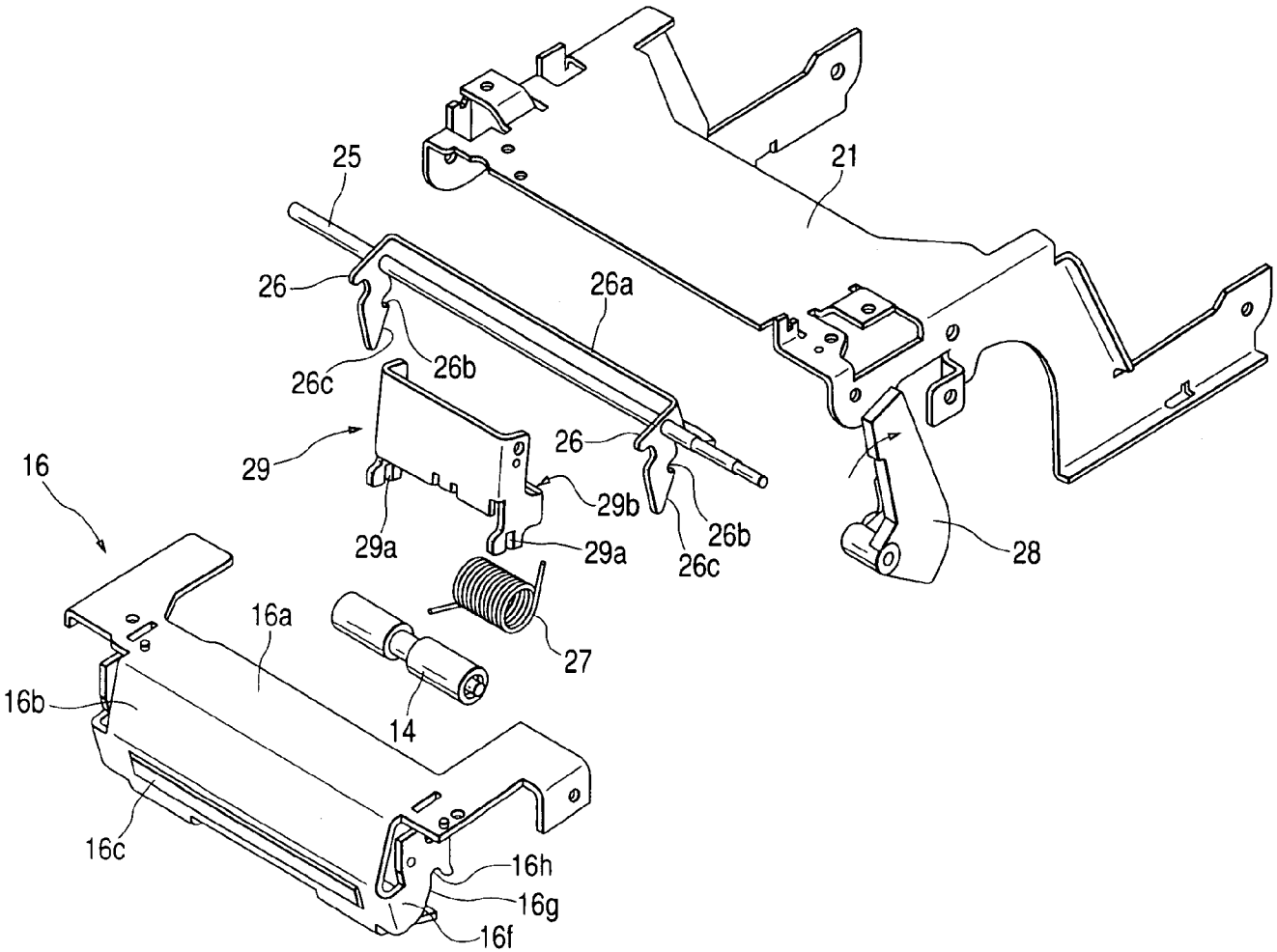
FIG. 6 is an exploded perspective view showing the cover frame of the printer unit of FIG. 1.

FIG. 4 is a perspective view showing the main part of the printer unit, illustrating a state in which the cover frame is closed, FIG. 5 is a perspective view showing the main part of the printer unit, illustrating a state in which the cover frame is opened, and FIG. 6 is an exploded perspective view showing the cover frame.

As shown in these drawings, the platen 16 comprises an attachment surface 16*a* to be attached integrally with a lower surface on the tip side of the cover frame 21, a downstream side guide surface 16*b* for guiding the continuous paper P on the downstream side of the print head 15, a print head opposed surface 16*c* (a platen acting surface) opposed to the print head 15 with a predetermined gap, and an upstream side guide surface 16*d* for guiding the continuous paper P on the upstream side of the print head 15. The paper press roller 14 is rotatably held on the backside of the platen 16 The paper press roller 14 protruded from a roller protrusion hole 16*e* formed on the upstream side guide surface 16*d* abuts on the paper feed roller 13. When the cover frame 21 is closed, the print head opposed surface 16*c* is to maintain a predetermined gap together with the print head 15 and is to hold a parallel state with the printing line of the print head 15. Description will now be given to a first positioning mechanism 22 and a second positioning mechanism 23 that serve to position the platen 16 with respect to the print head 15.

Figure 7:
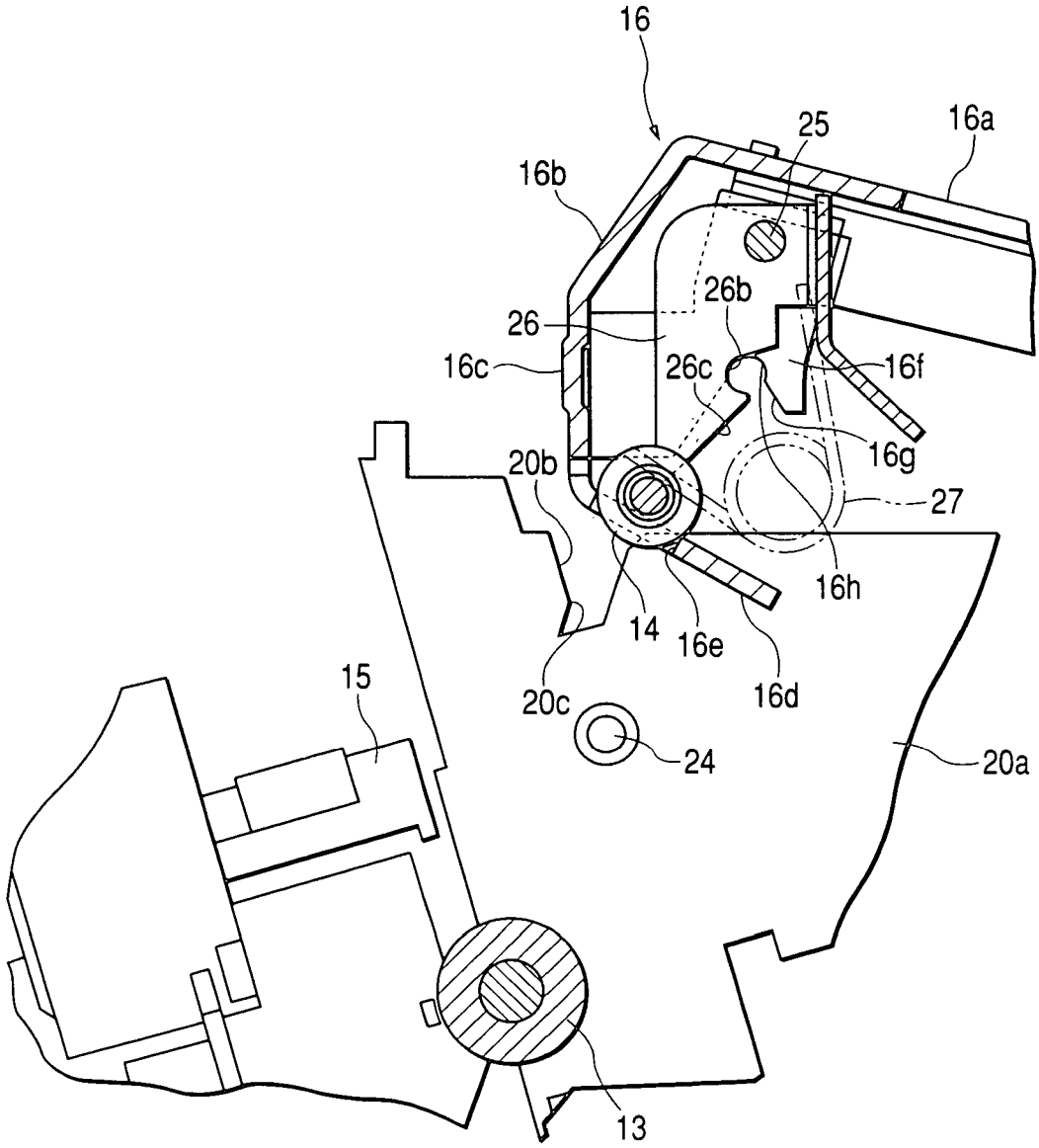
FIG. 7 is a longitudinal sectional view showing the main part, illustrating a process for closing the cover frame in the printer unit of FIG. 1.
Figure 8:
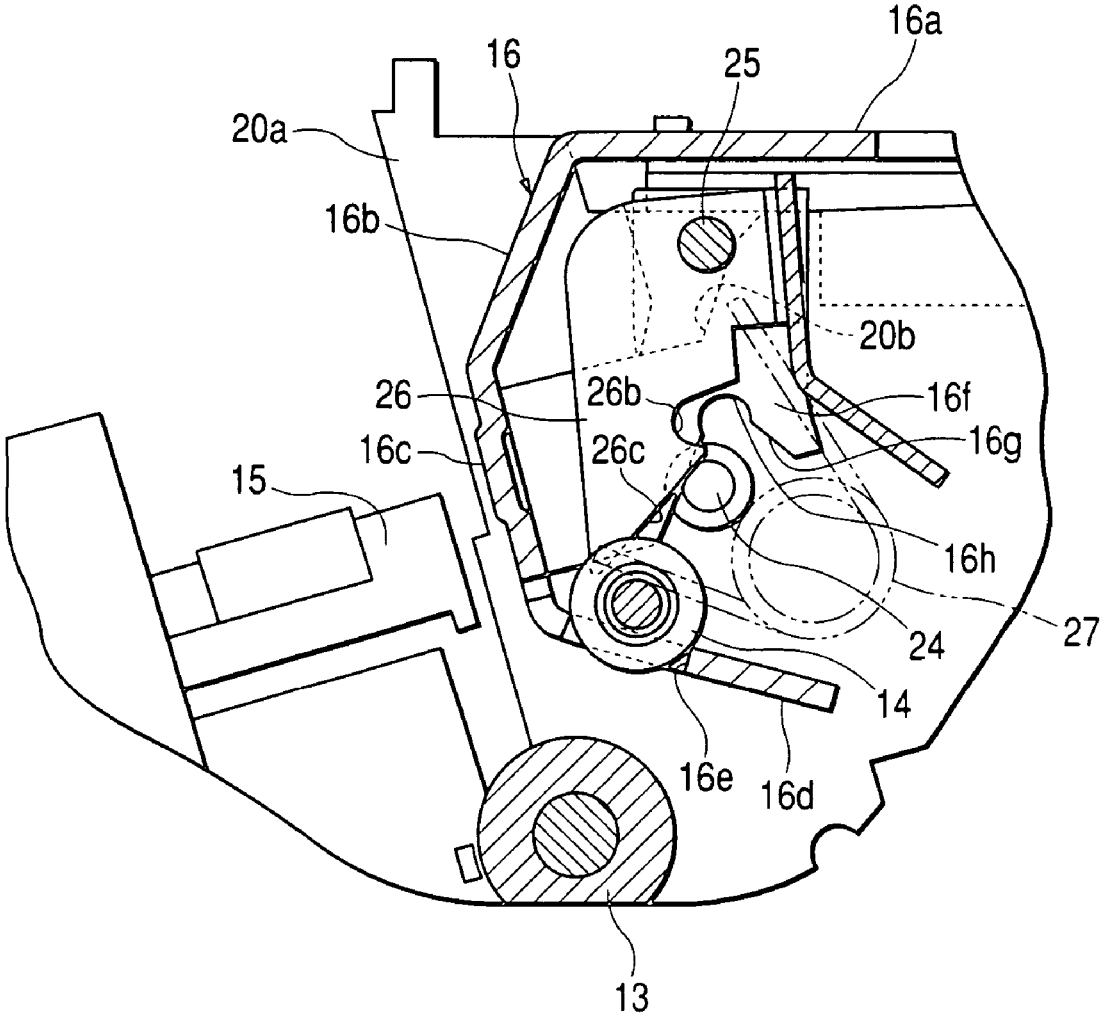
FIG. 8 is a longitudinal sectional view showing the main part, illustrating a state obtained immediately before the cover frame is closed in the printer unit of FIG. 1.
Figure 9:
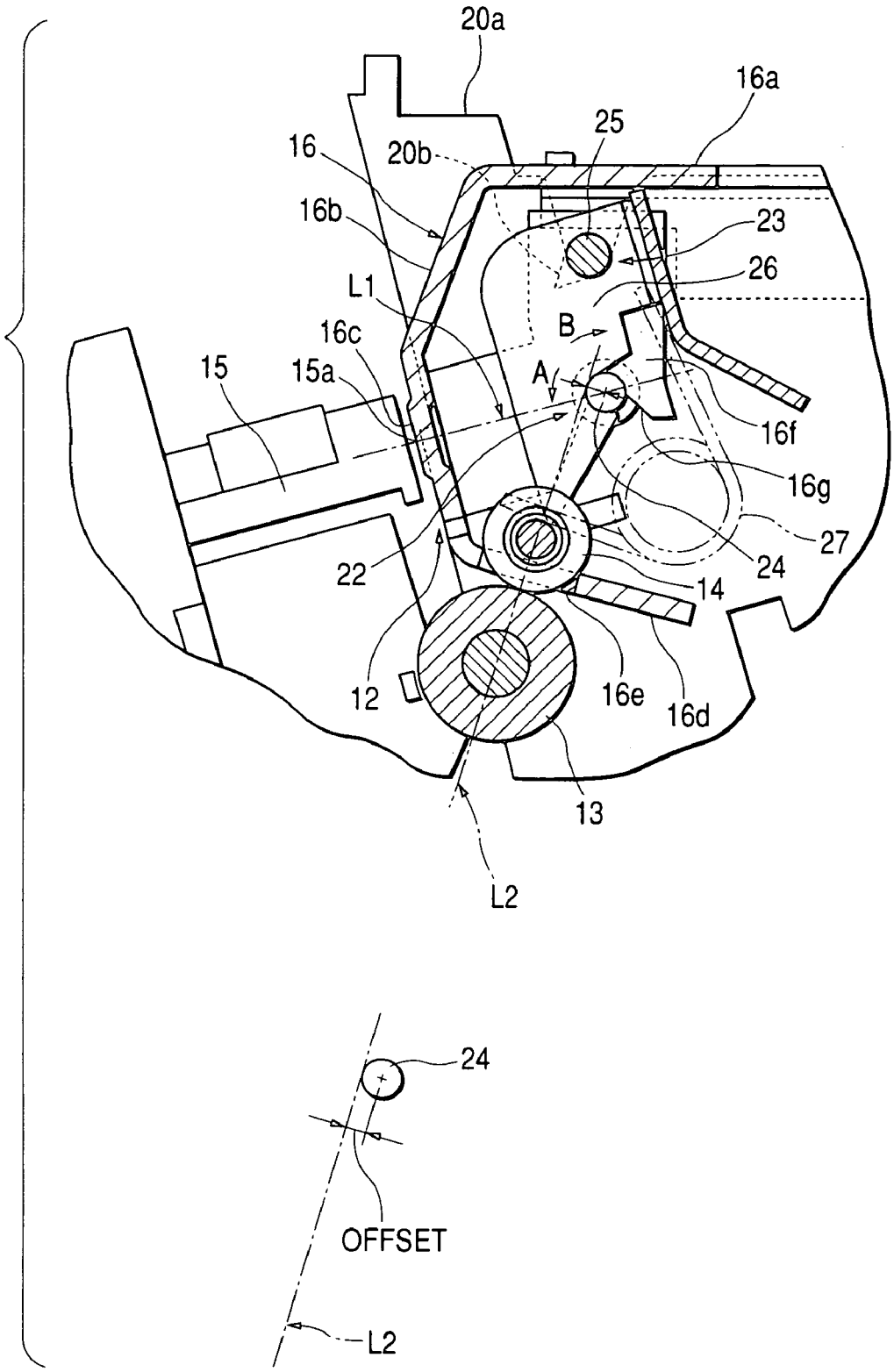
FIG. 9 is a longitudinal sectional view showing the main part, illustrating a state in which the cover frame is closed in the printer unit of FIG. 1.

FIG. 7 is a longitudinal sectional view showing the main part of the printer unit, illustrating a process in which the cover frame is closed, FIG. 8 is a longitudinal sectional view showing the main part of the printer unit, illustrating a state obtained immediately before the cover frame is closed, and FIG. 9 is a longitudinal sectional view showing the main part of the printer unit, illustrating a state in which the cover frame is closed. As shown in these drawings, the first positioning mechanism 22 comprises a pair of left and right lock pins (first positioning fulcrums) 24 protruded from the inside surface of the side frame 20*a*, a lock lever spindle 25 rotatably supported on left and right side plate portions 16*f* of the platen 16, a pair of left and right lock levers 26 rotatably supported on the lock lever spindle 25, and a pair of left and right first positioning grooves 16*g* formed on the left and right side plate portions 16*e* of the platen 16.

As shown in FIG. 6, the left and right lock levers 26 are coupled integrally through a coupling portion 26*a* and are urged rearward by a spring 27 provided between the coupling portion 26*a* and the shaft portion of the paper press roller 14 in a compression state. An engagement hook groove 26*b* and a taper portion 26*c* are formed in the tip portion of the lock lever 26. When the cover frame 21 is closed, the taper portion 26*c* comes in contact with the lock pin 24 before the cover frame 21 reaches a closing position The lock pin 24 guides the taper portion 26*c* so that the lock lever 26 is rotated forward as the cover frame 21 is closed (FIG. 8). As shown in FIG. 9, when the cover frame 21 reaches the closing position, the taper portion 26*c* gets over the lock pin 24 so that the lock lever 26 is rotated rearward (in a direction of an arrow A in FIG. 9) by the urging force of the spring 27. At this time, the engagement hook groove 26*b* is engaged with the lock pin 24 so that the operation for opening and closing the cover frame 21 is locked. An unlocking lever 28 is rotatably supported on one of the ends of the lock lever spindle 25. The lock lever 26 is rotated forward (in a direction of an arrow B in FIG. 9) when an operator rotates the unlocking lever 28 rearward so that the opening and closing lock of the cover frame 21 is released.

The first positioning groove 16*g* is formed on the lower end of the side plate portion 16*f* such that the lower side is opened to be fan-shaped. As shown in FIG. 8, when the cover frame 21 is closed, one of the groove inside edges of the first positioning groove 16*g* comes in contact with the lock pin 24 so that the platen 16 is positioned and guided. Moreover, when the cover frame 21 reaches the closing position as shown in FIG. 9, a groove upper end 16*h* of the first positioning groove 16*g* is engaged with the lock pin 24 so that the platen 16 is positioned. This state is held by the engagement of the lock pin 24 with the lock lever 26. Both the groove upper end 16*h* of the first positioning groove 16*g* and the engagement hook groove 26*b* of the lock lever 26 are formed arcuately along the outer periphery of the lock pin 24. In a full-closing state in which the groove upper end 16*h* of the first positioning groove 16*g* and the engagement hook groove 26*b* of the lock lever 26 are engaged with the lock pin 24, a change in the position of the platen 16 is restricted to only a rotation to be carried out around the lock pin 24.

As shown in FIG. 9, the lock pin 24 to be the positioning fulcrum of the first positioning mechanism 22 is provided on a first virtual line L1 as seen from the side. The first virtual line L1 passes through a printing position 15*a* of the print head 15 and is almost perpendicular to the print head opposed surface 16*c* of the platen 16 as seen from the side. The lock pin 24 is provided on the first virtual line L1 so that the amount of a change in a platen gap with the rotation of the platen 16 can be minimized.

The printing head 15 as described in this embodiment is used for the dot impact type printer such that nine wires are arranged on a paper transporting direction. In order to define the first virtual line L1, the printing position 15*a* is assumed to be the center between upper and lower wires, in this embodiment.

The second positioning mechanism 23 comprises the lock lever spindle (second positioning fulcrum) 25 and a pair of left and right second positioning grooves 20*b* formed on the left and right side frames 20*a*. The second positioning groove 20*b* is formed on the upper end of the side frame 20*a* such that the upper side is opened to be fan-shaped. When the cover frame 21 is closed as shown in FIG. 8, both of the left and right ends of the lock lever spindle 25 come in contact with one of the groove inside edges of the second positioning groove 20*b* so that the platen 16 is positioned and guided. Moreover, when the cover frame 21 reaches a closing position as shown in FIG. 9, both ends of the lock lever spindle 25 enter a narrow portion 20*c* of the second positioning groove 20*b*. The narrow portion 20*c* is set to have a slightly larger size than the diameter of the lock lever spindle 25. In a state in which the lock lever spindle 25 is positioned therein, it abuts on the groove inside edge of the second positioning groove 20*b* so that the rotation of the platen 16 around the lock pin 24 is restricted.

Figure 10:
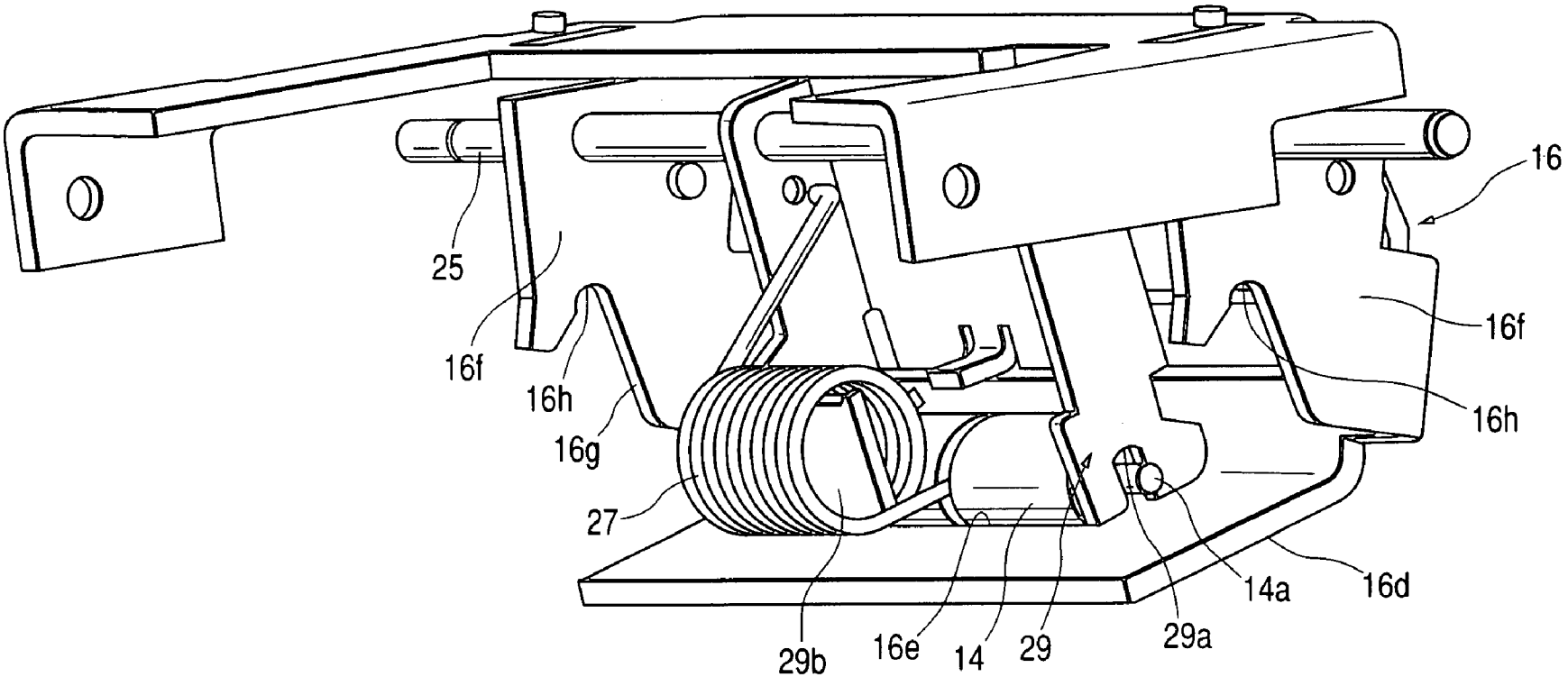
FIG. 10 is a perspective view showing the platen of the printer unit of FIG. 1 seen from the back side.

As shown in FIG. 10, a roller holder 29 for supporting the paper press roller 14 and the spring 27 is provided on the backside of the platen 16. The roller holder 29 is engaged with the lock lever spindle 25 and the roller protrusion hole 16*e* and is thus fixed integrally with the platen 16. The roller holder 29 is provided with a roller support groove 29*a* for rotatably supporting a paper press roller shaft 14*a* and a protrusion 29*b* for supporting the spring 27. The roller support groove 29*a* is slot-shaped and not only supports the paper press roller shaft 14*a* rotatably but also supports the paper press roller shaft 14*a* slidably in the direction of a second virtual line L2 passing through the centers of the paper feed roller 13 and the paper press roller 14. The protrusion 29*b* is a bent piece turned in a transverse direction, and the spring 27 is attached from one of the sides thereof. The spring 27 urges the lock lever 26 rearward as described above, and furthermore, urges the paper press roller shaft 14*a* downward and the paper press roller 14 is protruded from the roller protrusion hole 16*e* by the urging force of the spring 27. In a state in which the paper press roller 14 is positioned away from the paper feed roller 13, that is, a state in which the cover frame 21 is opened, both ends of the paper press roller shaft 14*a* urged by the spring 27 abut on the back face of the platen 16 so that further protrusion of the paper press roller 14 is restricted. On the other hand, in a state in which the cover frame 21 is closed, the paper press roller 14 abuts on the paper feed roller 13 and retreats to the backside of the platen 16. At this time, the paper feed roller 13 is pressed by the paper press roller 14 by constant force (the urging force of the spring 27). Consequently, a constant reaction force (corresponding to the urging force of the spring 27) is applied from the paper feed roller 13 to the paper press roller 14.

As shown in FIG. 9, the lock pin 24 to be the first positioning fulcrum is provided in a position offset from the second virtual line L2 by a predetermined amount as seen from the side. For this reason, a moment in a constant direction around the lock pin 24 is applied to the platen 16 by the reaction force acting on the paper press roller 14. In other words, the moment acts upon the platen 16 so that the platen 16 is rotated in the constant direction around the lock pin 24 to be a fulcrum. Therefore, it is possible to specify the position of the abutment of the lock lever fulcrum 25 and the second positioning groove 20*b*, thereby enhancing positioning precision in the second positioning mechanism 23.

Figure 11:
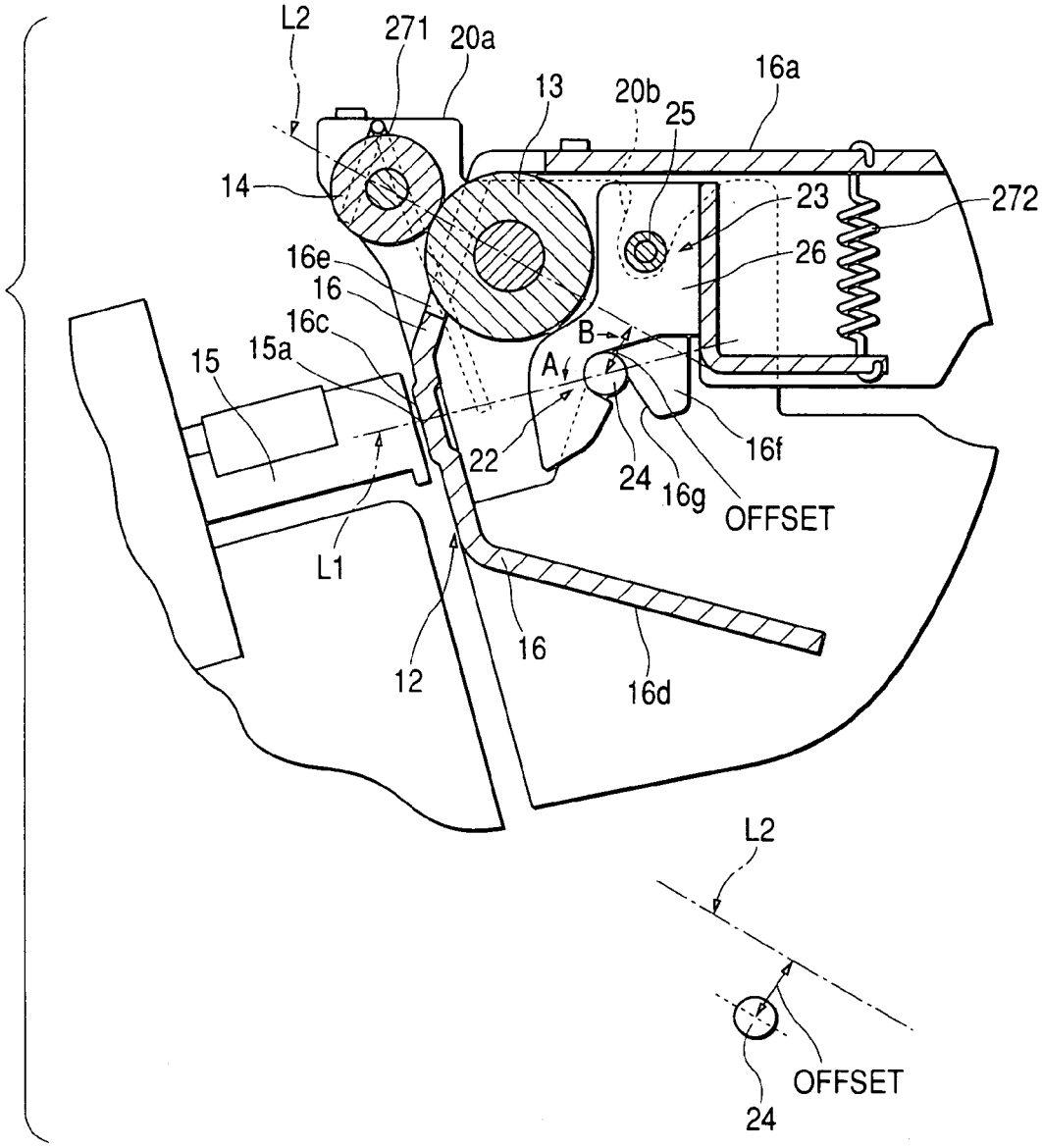
FIG. 11 is a longitudinal sectional view showing a main part, illustrating a state in which the cover frame of a printer unit according to another embodiment of the invention is closed.

FIG. 11 is a longitudinal sectional view showing a main part, illustrating a state in which the cover frame of a printer unit according to another embodiment of the invention is closed. The same reference numerals in FIG. 11 as those in FIGS. 1 to 10 denote the same elements and detailed description thereof will be omitted.

While the paper feed roller 13 and the paper press roller 14 are provided on the upstream side of the print head 15 in the paper path 12 in the embodiment shown in FIGS. 1 to 10, these items are provided on the downstream side of the print head 15 in the embodiment. More specifically, the roller protrusion hole 16*e* is provided on the downstream side guide face 16*b* of the platen 16 and the paper feed roller 13 is protruded therefrom. The paper press roller 14 is supported in a rotatable condition in a part on the upper side of the side frame 20*a* and comes in contact with the paper feed roller 13 protruded from the roller protrusion hole 16*e* by pressure when the cover frame 21 is closed. More specifically, while the continuous paper P is pushed and delivered from the upstream side toward the printing position 15*a* in the embodiment shown in FIGS. 1 to 10, the continuous paper P is pulled and delivered from the downstream side of the printing position 15*a* in the embodiment.

Moreover, while the paper feed roller 13 is provided on the body frame 20 side and the paper press roller 14 is provided on the cover frame 21 side in the embodiment shown in FIGS. 1 to 10, the paper feed roller 13 is provided on the cover frame 21 side and the paper press roller 14 is provided on the body frame 20 side in the embodiment. For this reason, a gear (not shown) is provided on one of the ends of the spindle of the paper feed roller 13 and is mated with a gear train 31 in a state in which the cover frame 21 is closed so that the power of the motor 30 is transmitted to the paper feed roller 13.

Furthermore, while the spring 27 urges the lock lever 26 rearward and the paper press roller 14 is urged toward the paper feed roller 13 in the embodiment shown in FIGS. 1 to 10, the paper press roller 14 is urged toward the paper feed roller 13 by a leaf spring 271 and the lock lever 26 is urged rearward by a coiled spring 272 in the embodiment.

In the same manner as in FIG. 9, also in an example shown in FIG. 11, a lock pin 24 to be a first positioning fulcrum is provided in a position offset by a predetermined amount from a second virtual line L2 passing through the centers of the paper press roller 14 and the paper feed roller 13 as seen from the side. Therefore, a moment in a constant direction around the lock pin 24 is applied to the platen 16 by a reaction force acting on the paper press roller 14. Consequently, it is possible to enhance positioning precision in a second positioning mechanism 23.

As described above, according to these embodiments, a printer unit 10 comprises the print head 15 provided on the body frame 20, the cover frame 21 provided on the body frame 20 to freely carry out an opening and closing operation, the platen 16 provided on the cover frame 21 and opposed to the print head 15 with a predetermined gap when the cover frame 21 is closed, a first positioning mechanism 22 for positioning the platen 16 with respect to the print head 15 when the cover frame 21 is closed and for restricting a change in the position of the platen 16 to (only) a rotation around a first positioning fulcrum (the lock pin 24), and the second positioning mechanism 23 for positioning the platen 16 with respect to the print head 15 when the cover frame 21 is closed and for restricting the rotation of the platen 16 around the first positioning fulcrum by abutment on a second positioning fulcrum (a lock lever spindle 25). In other words, the change in the position of the platen 16 is restricted to only the rotation by the first positioning mechanism 22 and the rotation is restricted by the second positioning mechanism 23. Therefore, it is possible to position the platen 16 with respect to the print head 15 with high precision without the influence of the attachment looseness of the cover frame 21 to the body frame 20. As a result, it is possible to maintain a predetermined gap between the print head 15 and the platen 16 and to provide the platen 16 in parallel with the printing line of the print head 15, thereby enhancing printing quality.

As seen from the side, moreover, the first positioning fulcrum (the lock pin 24) is provided on a first virtual line L1 which passes through the printing position 15*a* of the print head 15 and is almost perpendicular to a print head opposed surface 16*c* of the platen 16. Therefore, the amount of a change in the platen gap with the rotation of the platen 16 can be minimized. As a result, it is possible to enhance precision in the platen gap, thereby improving printing quality.

Moreover, the first positioning mechanism 22 comprises the lock pin 24 provided on the body frame 20 and acting as the first positioning fulcrum, the lock lever 26 rotatably supported on the platen 16 through the lock lever spindle 25 and engaged with the lock pin 24 to lock an operation for opening the cover frame 21 when the cover frame 21 is closed, and a first positioning groove 16*g* provided on the platen 16 and serving to restrict a change in the position of the platen 16 to a rotation around the lock pin 24 along the outer periphery of the lock pin 24 when the cover frame 21 is closed. Therefore, it is possible to constitute the first positioning mechanism 22 with such a simple change as to add the first positioning groove 16*g* to a related art lock lever mechanism. As a result, it is possible to reduce the number of components and to simplify the structure of the printer.

Furthermore, the second positioning mechanism 23 comprises the lock lever spindle 25 provided on the platen 16 and acting as the second positioning fulcrum, and a second positioning groove 20*b* provided on the body frame 20 and serving to restrict the rotation of the platen 16 around the lock pin 24 by the abutment of the lock lever spindle 25 on a groove inside edge when the cover frame 21 is closed. Therefore, the second positioning mechanism 23 can be constituted by utilizing the lock lever spindle 25. As a result, it is possible to reduce the number of components and to simplify the structure. In addition, a distance between the first positioning fulcrum and the second positioning fulcrum can be maintained to be constant by the lock lever 26. Consequently, it is possible to further enhance the positioning precision of the platen 16.

In addition, there are provided the paper feed roller 13 disposed on the body frame 20 and the paper press roller 14 disposed on the cover frame 21 and abutting on the paper feed roller 13 when the cover frame 21 is closed. The lock pin 24 (the first positioning fulcrum) is provided in the position offset from a second virtual line L2 passing through the centers of the paper feed roller 13 and the paper press roller 14 as seen from the side. Therefore, a moment in a constant direction around the lock pin 24 is applied to the platen 16 by a reaction force acting on the paper press roller 14. As a result, it is possible to specify the abutment position of the lock lever spindle 25 (the second positioning fulcrum) and the second positioning groove 20*b*. Thus, the positioning precision of the platen 16 can further be enhanced.

Moreover, there are provided urging or biasing means, for example, the springs 27 and 271 for urging the paper press roller 14 toward the paper feed roller 13 side. Therefore, a constant reaction force (spring force) can be applied to the paper press roller 14. As a result, a moment in a constant direction can be reliably applied to the platen 16 so that the positioning precision in the second positioning mechanism 23 can be enhanced.

While the embodiment of the invention has been described with reference to the drawings, the invention is not restricted to the matters described in the embodiment but can be changed and applied by the skilled in the art based on the scope of the claims, the detailed description of the invention and well-known techniques.

As described above, according to the invention, the platen provided on the cover frame is positioned with respect to the print head provided on the body frame when the cover frame is closed, and can be positioned with respect to the print head with high precision without the influence of the attachment looseness of the cover frame to the body frame. As a result, a predetermined gap can be maintained between the print head and the platen, and furthermore, the platen is provided in parallel with the printing line of the print head so that printing quality can be enhanced.

What is claimed is:

1. A printer comprising:

a body frame;

a print head provided on the body frame;

a cover frame provided on the body frame movable between an open position and a closed position;

a lock lever rotatably provided to lock an operation for opening and closing the cover frame when the cover frame is closed;

a platen assembly provided on the cover frame and including a platen opposed to the print head with a predetermined gap when the cover frame is closed and including at least one side plate on a corresponding at least one side of the platen;

a first positioning mechanism for positioning the platen with respect to the print head when the cover frame is closed and for restricting a change in a position of the platen to a rotation around a first positioning fulcrum, wherein both the lock lever and the at least one side plate engage the first positioning fulcrum when the cover frame is closed;

a paper feed roller provided on one of the body frame and the cover frame;

a paper press roller provided on the other of the body frame and the cover frame; and a spring urging the paper press roller against the paper feed roller and keeping the cover frame in the closed position.

2. A printer as claimed in claim 1 further comprising a second positioning mechanism positioning the platen with respect to the print head when the cover frame is closed and restricting the rotation of the platen around the first positioning fulcrum by abutment on a second positioning fulcrum.

3. The printer according to claim 2, wherein the second positioning mechanism includes:

a lock lever spindle provided on one of the platen and the cover frame and acts as the second positioning fulcrum; and a second positioning groove provided on the body frame and serving to restrict a rotation of the platen around the first positioning fulcrum by abutment of the lock lever spindle on a groove inner edge portion when the cover frame is closed.

4. A printer comprising:

a body frame;

a print head provided on the body frame;

a cover frame provided on the body frame movable between an open position and a closed position;

a platen provided on the cover frame and opposed to the print head with a predetermined gap when the cover frame is closed;

a first positioning mechanism for positioning the platen with respect to the print head when the cover frame is closed and for restricting a change in a position of the platen to a rotation around a first positioning fulcrum;

a paper feed roller provided on one of the body frame and the cover frame;

a paper press roller provided on the other of the body frame and the cover frame; and a spring urging the paper press roller against the paper feed roller and keeping the cover frame in the closed position, wherein the first positioning fulcrum is provided on a first virtual line which passes through a printing position of the print head and is substantially perpendicular to a surface of the platen opposed to the print head.

5. A printer comprising:

a body frame;

a print head provided on the body frame;

a cover frame provided on the body frame movable between an open position and a closed position;

a platen provided on the cover frame and opposed to the print head with a predetermined gap when the cover frame is closed;

a first positioning mechanism for positioning the platen with respect to the print head when the cover frame is closed and for restricting a change in a position of the platen to a rotation around a first positioning fulcrum;

a lock lever rotatably provided to lock an engagement between the body frame and the cover frame and to unlock the engagement, wherein both the lock lever and the first positioning mechanism engage the first positioning fulcrum when the cover frame is closed;

a paper feed roller provided on one of the body frame and the cover frame;

a paper press roller provided on the other of the body frame and the cover frame; and a spring urging the paper press roller against the paper feed roller, the spring keeping the cover frame in the closed position and urging the lock lever to lock the engagement.

* * * * *